US011149364B2

(12) United States Patent
Engesser

(10) Patent No.: US 11,149,364 B2
(45) Date of Patent: Oct. 19, 2021

(54) RIBBON NEEDLE LOOM

(71) Applicant: Textilma AG, Stansstad (CH)

(72) Inventor: Bernhard Engesser, Niederwil (CH)

(73) Assignee: Textilma AG, Stansstad (CH)

( * ) Notice: Subject to any disclaimer, the term of this patent is extended or adjusted under 35 U.S.C. 154(b) by 331 days.

(21) Appl. No.: 16/317,239

(22) PCT Filed: Jun. 26, 2017

(86) PCT No.: PCT/EP2017/065746

§ 371 (c)(1),
(2) Date: Aug. 26, 2019

(87) PCT Pub. No.: WO2018/010944

PCT Pub. Date: Jan. 18, 2018

(65) Prior Publication Data

US 2019/0376213 A1 Dec. 12, 2019

(30) Foreign Application Priority Data

Jul. 13, 2016 (EP) ..... 16179210

(51) Int. Cl.

| | |
|---|---|
| ***D03D 35/00*** | (2006.01) |
| ***D03D 47/06*** | (2006.01) |
| ***D03D 47/10*** | (2006.01) |
| *B25B 23/10* | (2006.01) |
| *D03D 47/38* | (2006.01) |

(52) U.S. Cl.

CPC ..... *D03D 35/00* (2013.01); *D03D 47/06* (2013.01); *D03D 47/10* (2013.01); *B25B 23/103* (2013.01); *D03D 47/38* (2013.01)

(58) Field of Classification Search

CPC ..... D03D 35/00; D03D 47/06; D03D 47/10; D03D 47/38; D03D 2700/10; B25B 23/103

See application file for complete search history.

(56) References Cited

U.S. PATENT DOCUMENTS

| | | | |
|---|---|---|---|
| 3,674,058 | A | 7/1972 | Sellers |
| 4,305,434 | A | 12/1981 | Muller |

FOREIGN PATENT DOCUMENTS

| | | | |
|---|---|---|---|
| CH | 633 331 | A | 11/1982 |
| CN | 203212741 | U | 2/2013 |
| DE | 2102628 | A1 | 7/1971 |

*Primary Examiner* — Robert H Muromoto, Jr.

(74) *Attorney, Agent, or Firm* — George Pappas; Barrett & McNagny LLP

(57) ABSTRACT

In order to improve the design of a ribbon needle loom for applications in which the woven material (9) shall have a variable width, it is proposed to arrange the weft needle (10, 16) and also the knitting needle (10*b*, 16*b*) serving to knit the weft thread (14, 15) at the side directed away from the weft insertion onto a common, displaceable carrier (10*c*, 16*c*). As a further improvement, in order to be able to produce symmetrical woven material (9) with such a ribbon needle loom, a bilateral weft-insertion is proposed, wherein the two weft needles (10, 16) and the two knitting needles (10*b*, 16*b*) by means of which the respective weft thread (14, 15) is knitted at the side directed away from the weft insertion are each disposed on a common, displaceable carrier (10*c*, 16*c*). Advantageously, the carriers (10*c*, 16*c*) do not hinder each other upon displacement, but rather are arranged on top of each other.

20 Claims, 10 Drawing Sheets

RIBBON NEEDLE LOOM

This application claims priority from PCT application No. PCT/EP2017/065746 filed Jun. 26, 2017 which claims priority from European application No. EP16179210.6 filed Jul. 13, 2016, the disclosures of which are incorporated herein by reference.

TECHNICAL FIELD

The invention relates to a ribbon needle weaving.

BACKGROUND OF THE INVENTION

Ribbon needle weaving looms are used for weaving ribbons, usually with widths of up to approximately 40 cm, and they insert the weft thread into the open shed by means of a weft needle. Such a weaving loom, in which as usual the drive of the weft insertion needle is connected to the main shaft of the weaving loom by means of mechanical coupling, is known from CH 633 331 A. Thereby, weft insertion needles of a ribbon weaving loom usually make a crescent-shaped motion, which—as described in CH 633 331 A—originates from the reciprocating pivoting motion derived from the main shaft. However, for certain applications, this type of weaving loom reaches certain limits. Such a type of application is the production of ribbons with varying bandwidth. In such a weaving loom, the transition from a larger width to a smaller width and vice versa results in unappealing weave regions, which are perceived as flawed by the person skilled in the art. This is because—particularly in the transition region between a larger to a smaller and from a smaller to a larger ribbon width—the weft thread tension cannot be kept constant in a simple manner. Indeed, it is not even guaranteed that both a too high thread tension with the risk of a thread breakage (at the time point, at which the knitting needle receives the weft thread) as well as a too small thread tension at the beat-up of the reed can be avoided. These problems will henceforth be explained by reference to drawings 1*a* to 1*e*. In FIG. 1*a*, there is shown a weft thread insertion unit of known type, in which the weft head is fixed while the reed and the knitting needle are displaceable in accordance with the desired bandwidth. FIG. 1*a* shows the weft thread insertion unit in the operating mode of the wide ribbon. The maximum bandwidth is woven, the reed is lowered and the knitting needle is positioned maximally the right. During weft insertion, the weft needle moves to the right beyond the knitting needle so far that the weft thread is reliably inserted into the knitting needle. The maximum weft tension is slightly higher than the weft tension at the reed beat-up. As can be seen from FIG. 1*b*, the weft thread tension at the thread guide 3 can be kept at a value between 0.5 N and 0.15 N over the entire phase of the weaving process from 0° to 360°. This range appears acceptable, with a thread breakage not being to be feared in the upper region while a residual tension remains in the lower region at the beat-up of the reed onto the woven material, which guarantees the required tightening of the weft thread. If now the width of the ribbon to be woven shall be reduced, that means the width of the woven material is smaller, as it is intended, for example, for watch bands, straps of tops—in particular women's tops—suspenders, etc., a situation according to FIG. 1*c* is set or performed when using a weft thread insertion unit of known type. The minimum bandwidth is woven. The reed is raised maximally. The knitting needle is positioned maximally to the left. The weft needle moves too far beyond the knitting needle during weft insertion (distance amount e). The ratio of the maximum weft tension to the tension at the reed beat-up becomes unfavorable, as shown in FIG. 1*d*. If the weft transport speed is adjusted in such manner that the maximum weft tension does not increase, then the weft thread tension will decrease at the reed beat-up. However, if the weft transport speed is adjusted in such manner that the weft thread tension remains unchanged at the reed beat-up, then the maximum weft tension increases to a value which can lead to a thread breakage (FIG. 1*e*).

SUMMARY OF THE INVENTION

The object of the invention is to configure a weft insertion in a ribbon needle weaving loom in such manner that a transition from a wide ribbon to a narrow ribbon is easily possible and that the weaving faults in weaving looms, in which the weft thread is tied off upon the weft thread insertion by the knitting thread by means of a knitting needle, is avoided.

This object is achieved by a ribbon needle weaving loom as described herein. Thereby, the measures of the invention initially have the consequence that the weft thread tension at "normal" weft thread transport speed at the reed beat-up does not decrease too much and also that the disadvantages of the possible countermeasure, namely a lowering of the weft transport speed so that the maximum weft thread tension falls into a range in which a thread breakage is not possible, are avoided.

Particularly advantageous are the measures of the invention according to which there are provided two weft thread insertion needles being countercurrently introducible into the shed for inserting two weft thread loops into the shed and two knitting devices, by means of which a respective weft thread is knitted at the respective side directed away from the weft insertion. In the present context, the term "weft thread loop" shall designate the section of a weft thread which is to be incorporated from the insertion side all the way to the knitting device and back into the warp threads. Thereby one weft thread insertion needle and one knitting device each are each arranged on a respective common carrier, which is displaceable in and against the weft direction. In order to thereby be able to exploit the entire range of displaceability, it is advantageous if the two carriers with their associated weft thread insertion needles and knitting devices are arranged in such manner that the carriers with their associated weft thread insertion needles and knitting devices are displaceable independently to each other, preferably by means of a height staggering of the carrier.

In principle, the reed will have in the upper region thereof, a respective distance between reed teeth which is different than in the lower region thereof, and will be furthermore be displaceable in its height for beating up the woven material of variable width. For unsymmetrical variations of the bandwidth, it is advantageous if the reed is also displaceable in or against the weft direction. If the reed is displaceable in its height and can be pivoted around an axis directed in weft direction for beating up the woven material, it may furthermore be advantageous if the axis can be displaced in or against the warp thread direction to compensate for the different beat-up angles which result from displacing of the height of the reed.

The ribbon needle weaving loom preferably comprises electromechanic actuating drives for displacement of the carrier or the carriers (10*c*, 16*c*), respectively, as well as for displacement of the reed in height and also laterally in or against the weft direction. For this purpose, it will advantageously also comprise a control unit for controlling the said electromechanic actuating drives. This control can be freely programmable, so that with respect to the operating mode no restrictions are necessary.

The aforementioned elements as well as those claimed and described in the following exemplary embodiments, to be used according to the invention, are not subject to any particular conditions by way of exclusion in terms of their size, shape, use of material and technical design, with the result that the selection criteria known in the respective field of application can be used without restrictions.

BRIEF DESCRIPTION OF THE DRAWINGS

Further details, advantages and features of the object of the present invention will become apparent from the following description and the corresponding drawings, in which ribbon needle weaving looms and their weft thread insertion units according to the present invention are illustrated by way of example. In the drawings there are shown in.

DETAILED DESCRIPTION OF THE PREFERRED EMBODIMENTS OF THE INVENTION

Figure 1B:
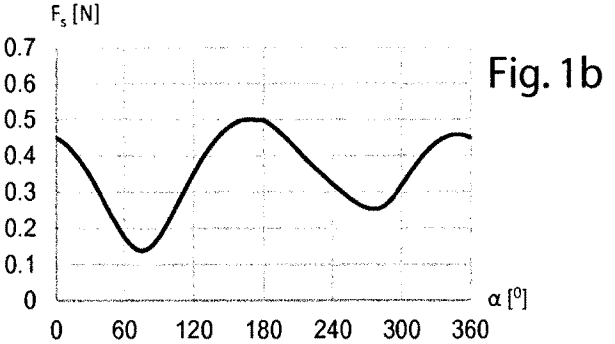
FIG. 1*b* the tension ratios of the weft thread according to FIG. 1*a;*
Figure 1D:
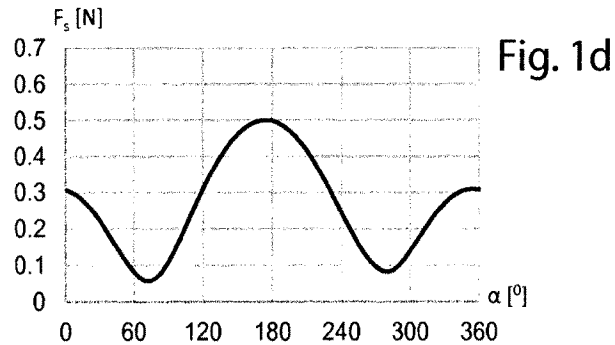
FIG. 1*d* the tension ratios of the weft thread according to FIG. 1*c*, wherein the weft thread transport speed is maintained.
Figure 1E:
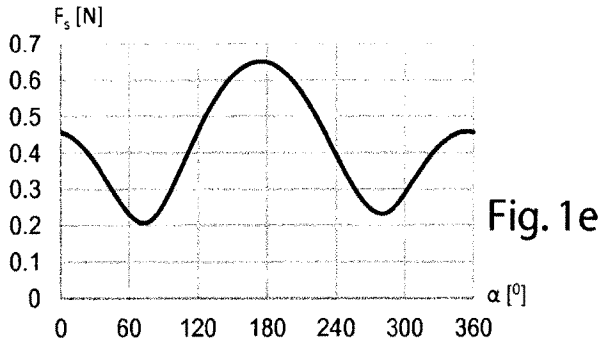
FIG. 1*e* the tension ratios of the weft thread according to FIG. 1*c*, at reduced weft thread transport speed.
Figure 1C:
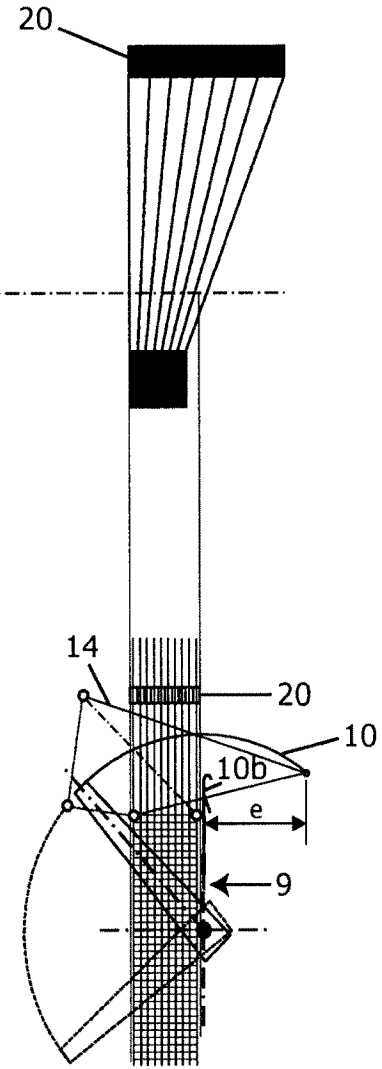
FIG. 1*c* the weft thread insertion unit of known type according to FIG. 1*a*, in the operating mode of the narrower ribbon.
Figure 1A:
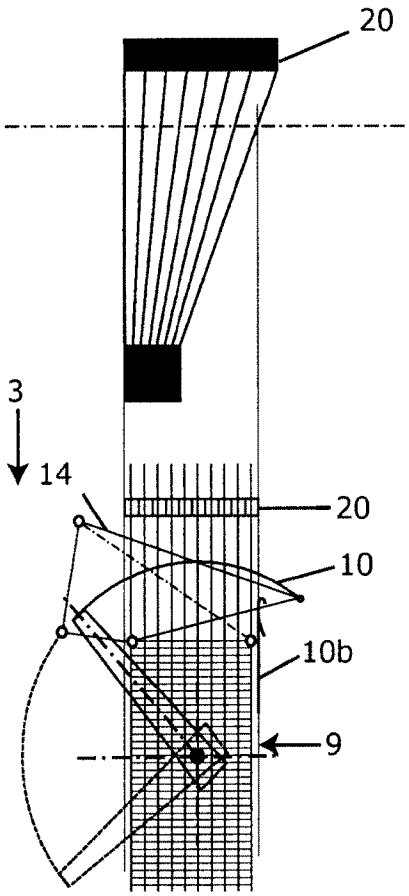
FIG. 1*a* a weft thread insertion unit of known type, in which the weft head is fixed while the reed and the knitting needle are displaceable according to the desired bandwidth, in the operating mode of the wide ribbon.
Figure 2:
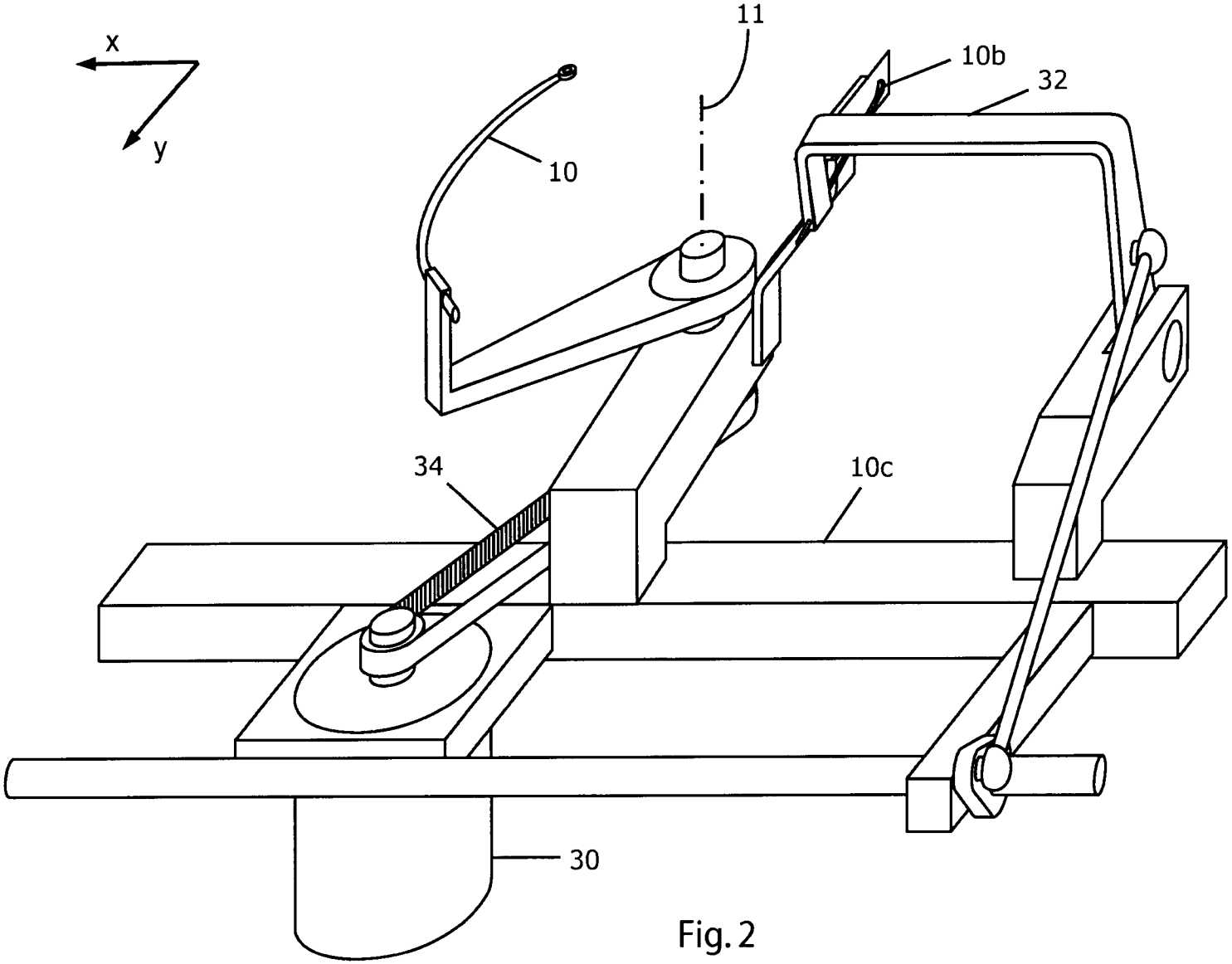
FIG. 2 a 3D representation of the weft thread insertion unit according to an exemplary embodiment of the present invention with weft thread insertion from the left.
Figure 3A:
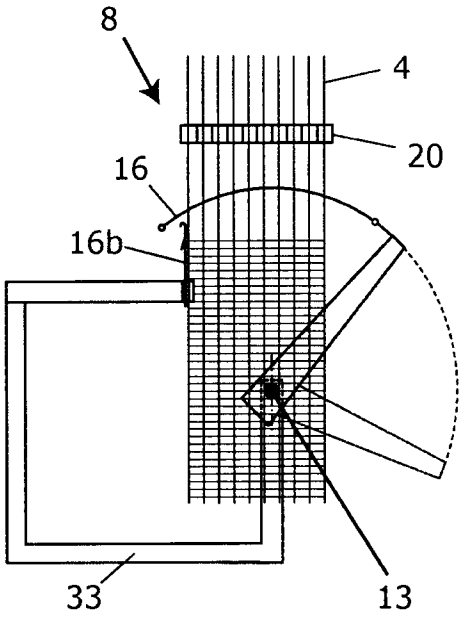
FIG. 3*a* the representation of the weft thread insertion according to FIG. 3.
Figure 2A:
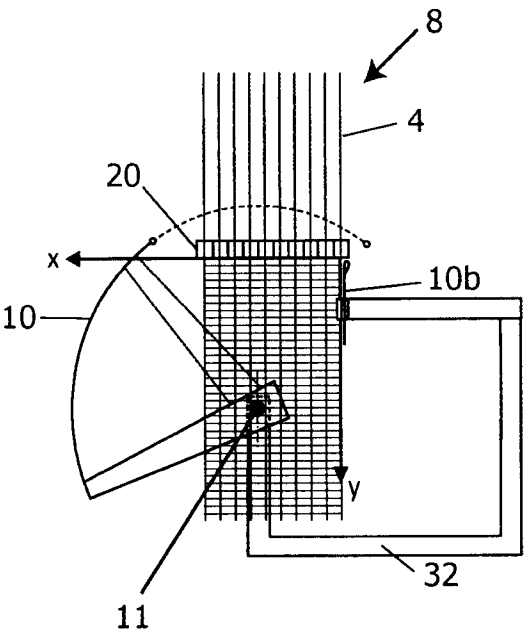
FIG. 2*a* the representation of the weft thread insertion according to FIG. 2.
Figure 3:
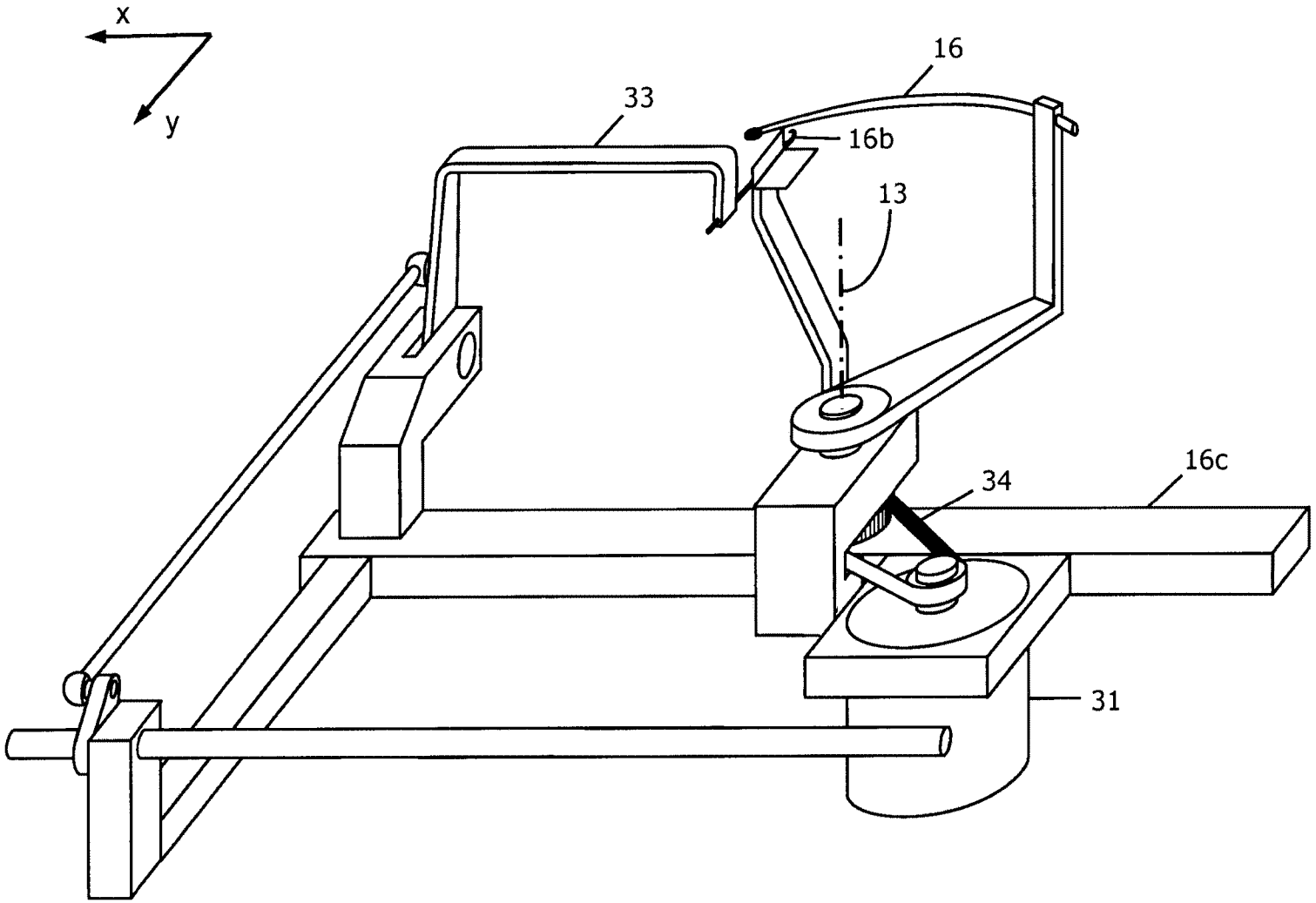
FIG. 3 a 3D representation of the weft thread insertion unit according to an exemplary embodiment of the present invention with weft thread insertion from the right.

In FIGS. 2 and 3, there is shown a simple embodiment of the present invention by means of the essential elements. In FIG. 2, the weft thread insertion is provided from the left by the weft thread insertion needle 10, wherein the weft thread insertion needle 10 and the (first) knitting needle 10*b*, by means of which the weft thread 14 is enmeshed after weft thread insertion, is arranged on a common carrier 10*c*, which is displaceable in and against the weft thread insertion direction x, and the weft thread insertion needle 10 is driven by means of a toothed pulley drive 34 of a rotary actuator 30. It should be emphasized that a drive through the main shaft of the weaving loom is nonetheless possible and practically equivalent. In FIG. 2*a*, there is schematically shown the process of weft thread insertion from above. The axis 11 of the weft thread insertion needle 10 or its pivot bearing and associated knitting needle 10*b* or its linear bearing are firmly connected to each other by means of bracket 32. An additional drive moves the knitting needle 10*b* in the y direction (direction of the warp thread) back and forth to pick the weft thread and to enmesh it with the previous weft. This additional drive and the enmeshing process, respectively, are not shown here. In FIG. 2*a*, there is shown the time point of the beat-up of the reed 20, at which the weft thread insertion needle 10 has moved out of the shed 8, the reed 20 beats up the weft at the woven material 9 and the knitting needle 10*b* is drawn before the reed beat-up point.

Figure 4B:
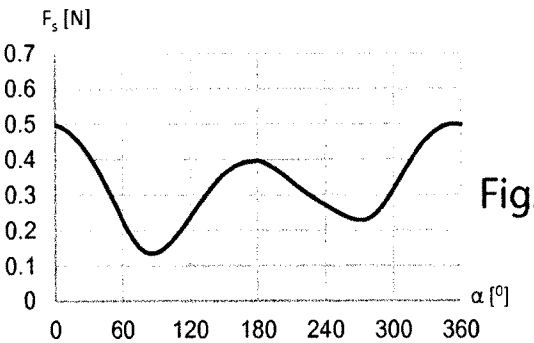
FIG. 4*b* the tension ratios of the weft thread according to FIG. 4*a;*
Figure 4D:
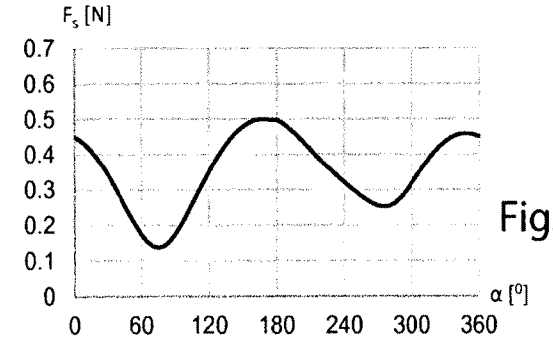
FIG. 4*d* the tension ratios of the weft thread according to FIG. 4*c*, wherein the weft thread transport speed is maintained.
Figure 4E:
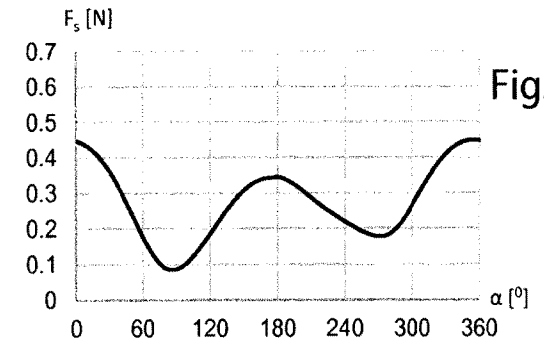
FIG. 4*e* the tension ratios of the weft thread according to FIG. 4*c*, at reduced weft thread transport speed.
Figure 4C:
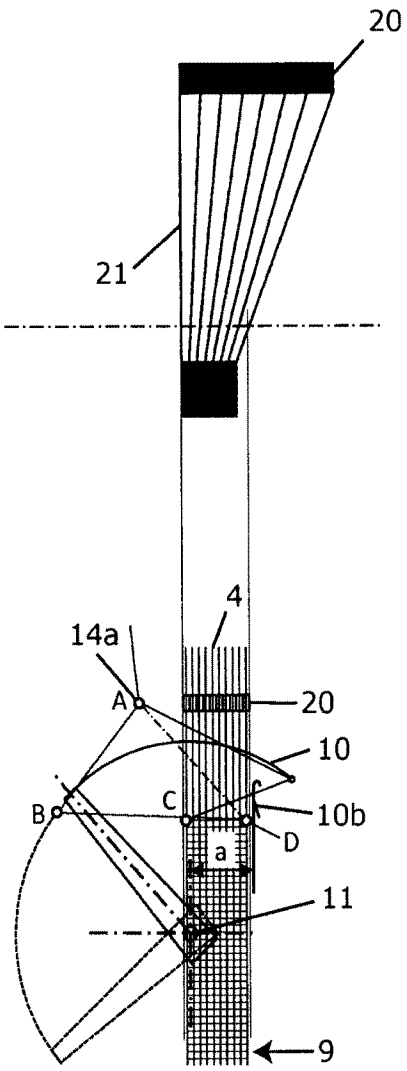
FIG. 4*c* the weft thread insertion unit of known type according to FIG. 4*a*, in the operating mode of the narrower ribbon.
Figure 4A:
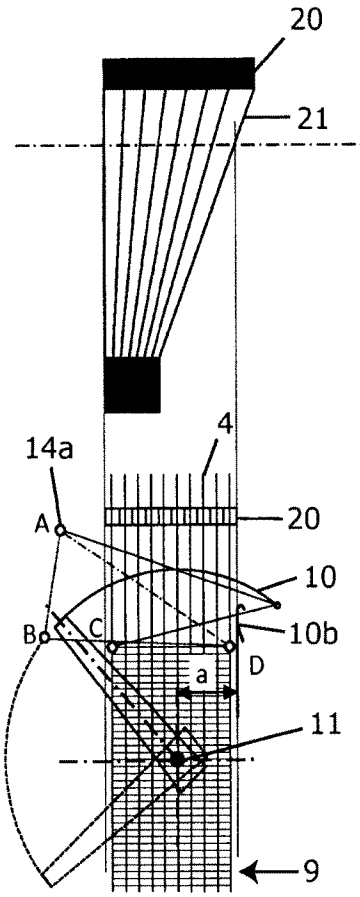
FIG. 4*a* a weft thread insertion unit according to FIG. 2, in which the weft head is coupled with the knitting needle and the reed is displaceable in accordance with the desired bandwidth, in the operating mode of the wide ribbon.

In FIGS. 4*a* to *e*, the weaving process is explained by means of the tension ratio of the weft thread over the weaving phase (0-360°) in accordance with or in contrast to FIGS. 1*a* to 1*e*. In FIG. 4*a*, the situation is shown, in this case with weft thread insertion from the left, when the maximum bandwidth is woven. The reed 20 is lowered. The knitting needle 10*b* is positioned maximally to the right, the weft axis is arranged at a constant distance amount a to the left thereof. In contrast, FIG. 4*c* shows weaving with the minimum bandwidth. The reed 20 is raised maximally. The knitting needle 10*b* is positioned maximally to the left, the weft thread axis is at a constant distance a. The weft thread tension at the reed beat-up increases because the weft thread is pulled further to the left by the weft needle. The ratio of the sum of the line segment A-B-D to the line segment A-D is increased. By reducing the weft transport speed, the weft thread tension at the reed beat-up can again adjusted to the same value as in the case of the wide ribbon, without increasing the maximum weft thread tension.

Figure 8B:
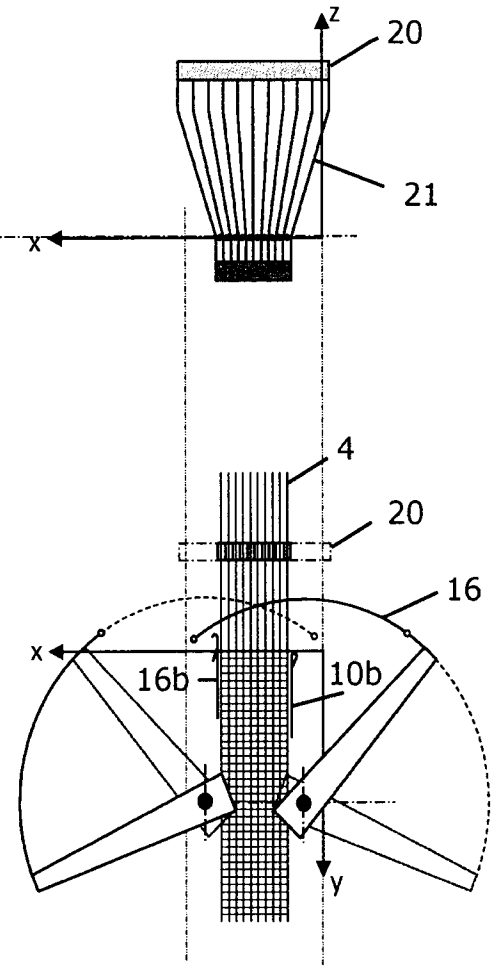
FIG. 8*b* the representation of the carrier- and reed position according to the exemplary embodiment of FIGS. 5, 6, 7*a* and 7*b* with symmetrical bandwidth variation, with a narrow band.

In the aforementioned exemplary embodiment both a symmetric and also an asymmetric bandwidth variation can be set, as will be explained with reference to FIGS. 8*a*, 8*b* (symmetric bandwidth variation) and 9*a*, 9*b* (asymmetric bandwidth variation).

Figure 5:
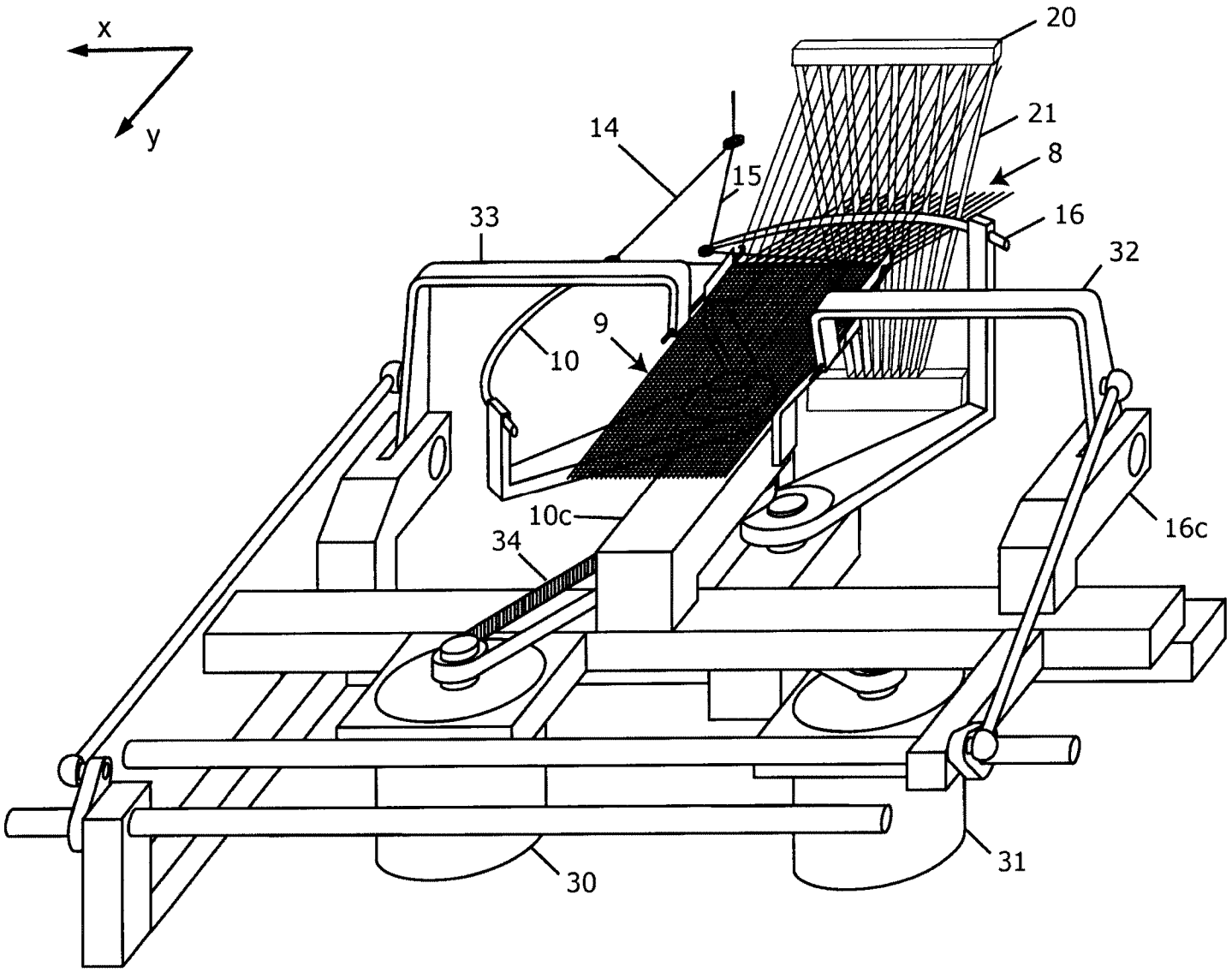
FIG. 5 a 3D representation of the weft thread insertion unit according to an exemplary embodiment with two-sided weft insertion from the left and from the right, when the ribbon becomes wide.
Figure 6:
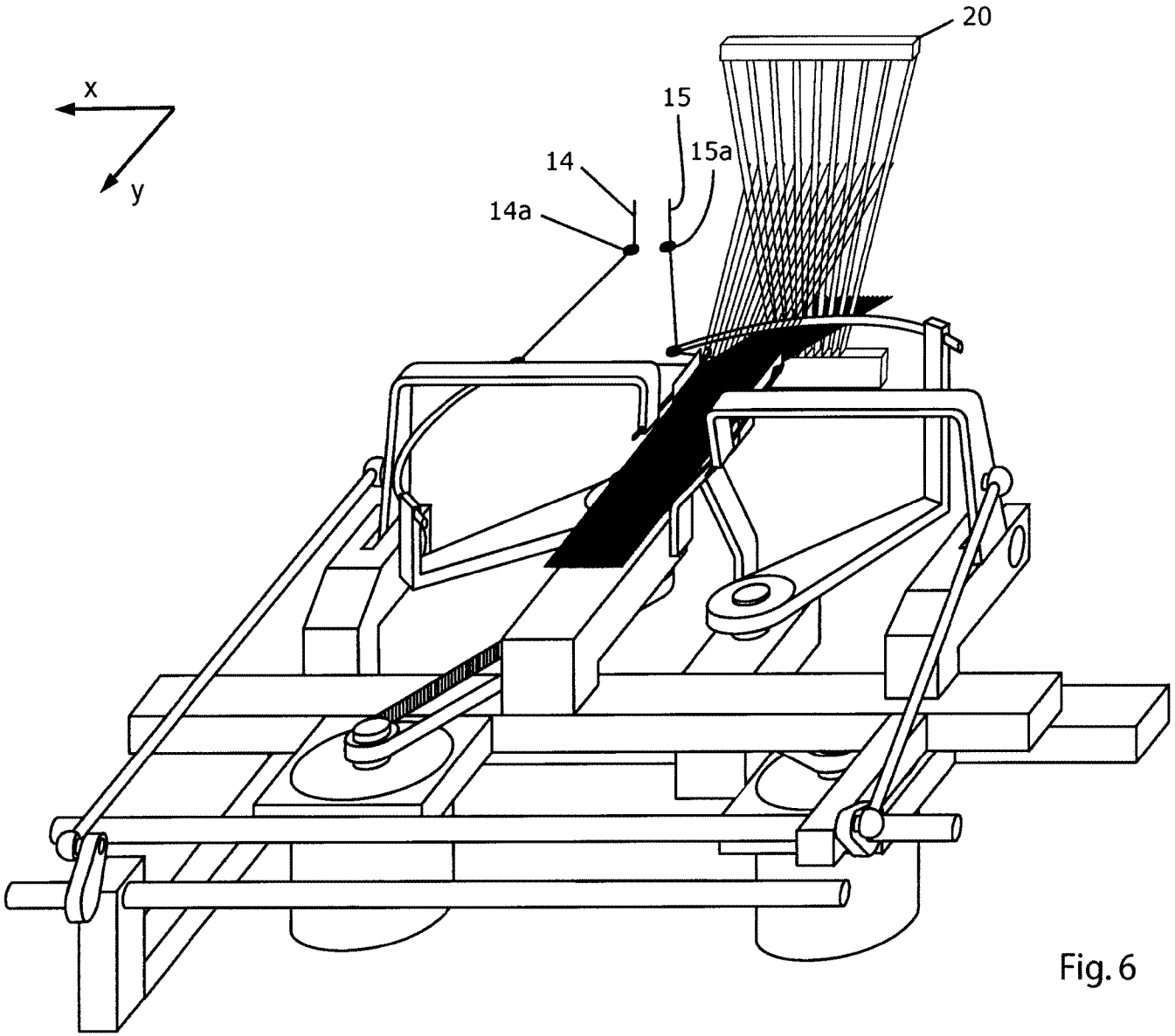
FIG. 6 a 3D representation of the weft thread insertion unit according to an exemplary embodiment with two-sided weft insertion from the left and from the right, when the ribbon becomes narrow.
Figure 7A:
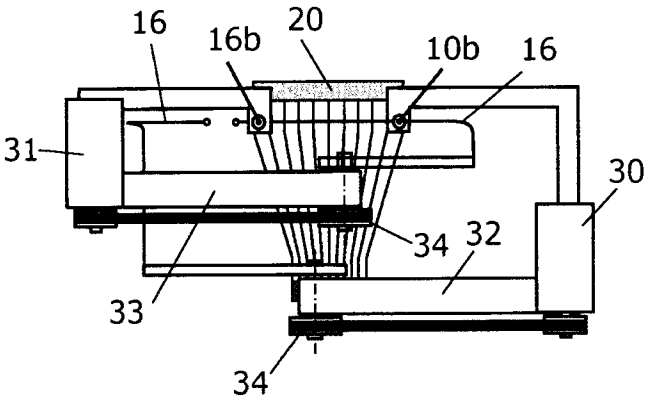
FIG. 7*a* a representation of the height staggering according to the exemplary embodiment of FIGS. 5 and 6, from the front FIG. 7*b* a representation of the height staggering according to the exemplary embodiment of FIGS. 5, 6 and 7*a*, from above.
Figure 7B:
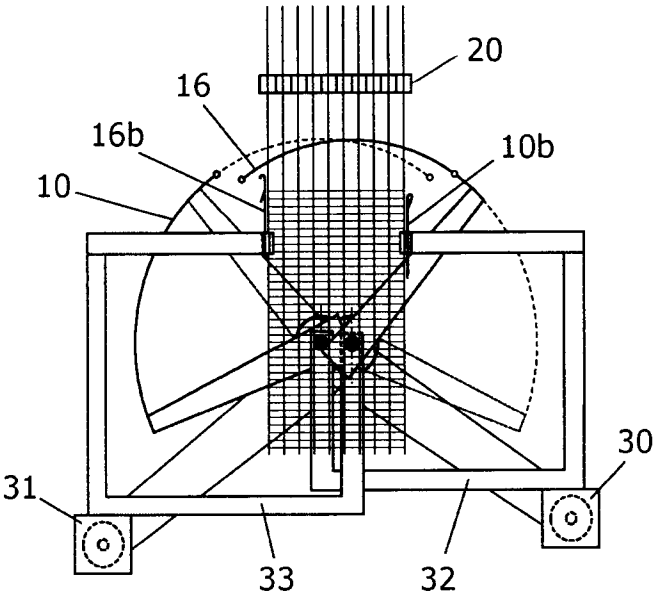

In FIGS. 5 to 9*b*, there is described a second exemplary embodiment with two-sided weft insertion from the left and from the right. FIG. 5 shows a device when the ribbon (woven material 9) is wide. The reed 20 is lowered, the weft heads are positioned in mutual contact. In FIG. 6 it is shown accordingly that the ribbon is made narrow. The reed 20 is raised, the weft heads have positioned apart from each other. Otherwise, the device is practically a combination of the devices according to FIGS. 2 and 3. However, it should be noted that the two device components shall not interfere with each other. The solution for this is shown in FIGS. 7*a* and 7*b*, namely a height staggering of the associated device parts insofar as they could interfere with each other.

If the weft insertion shall occur from the right and from the left, the connecting brackets 32 and 33 including the associated components—knitting needles 10*b* and 16*b*, weft needles 10 and 16, driving motors 30 and 31—should be arranged staggered in height. Moreover, they shall leave enough space so that the weft needles/weft levers can carry out their pivotal movement unhindered. The drive of the weft axes again occurs, by way of example, by means of a toothed pulley drive from a respective servo motor 30 and 31, which transmit their rotational movement to a respective toothed pinion on the weft axes.

Figure 8A:
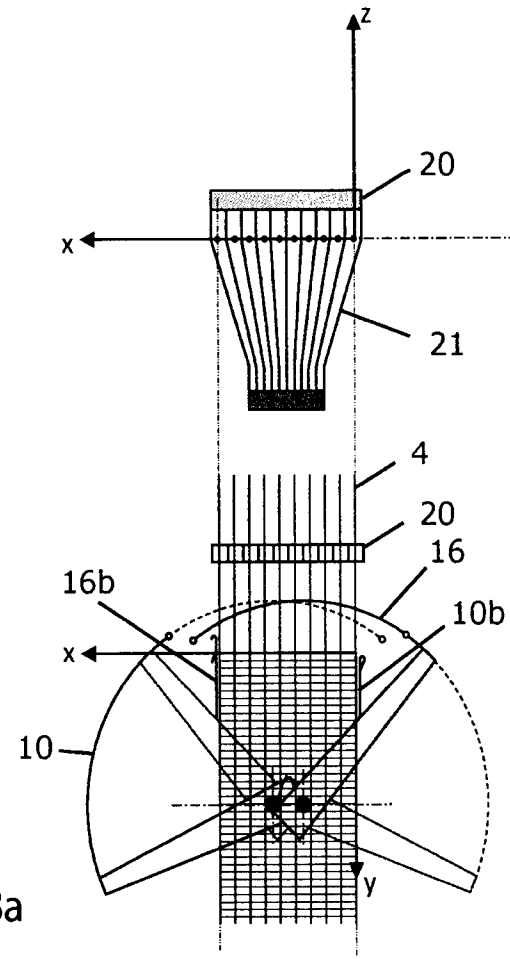
FIG. 8*a* the representation of the carrier- and reed position according to the exemplary embodiment of FIGS. 5, 6, 7*a* and 7*b* with symmetrical bandwidth variation, with a wide band.

In FIG. 8*a*, the reed is in the lowest z position, so that the warp threads at the reed beat-up point are spread apart maximally and, consequently, the bandwidth becomes maximal. The two weaving heads with their associated knitting needles are positioned in x direction in such manner that the bandwidth becomes maximal. In FIG. 8*b*, the reed is in the uppermost z position, so that the warp threads 4 at the reed beat-up point are maximally spread and, thus the bandwidth becomes maximal. The two weaving heads with their associated knitting needles 10*b* and 16*b* are spaced apart from each other in x direction by the same path so that the bandwidth becomes maximal.

Figures 9A, 9B:
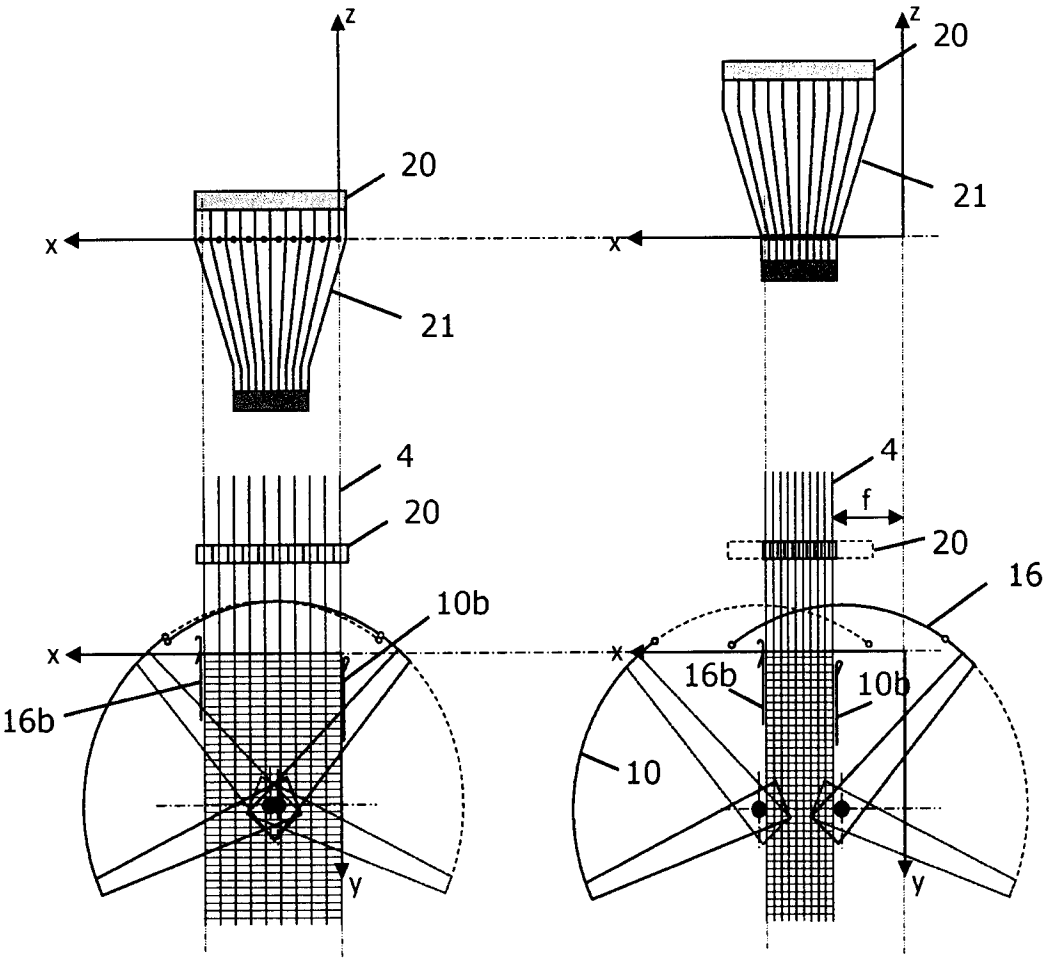
FIG. 9*a* the representation of the carrier- and reed position according to the exemplary embodiment of FIGS. 5, 6, 7*a* and 7*b* with asymmetrical bandwidth variation, with a wide band.
FIG. 9*b* the representation of the carrier- and reed position according to the exemplary embodiment of FIGS. 5, 6, 7*a* and 7*b* with asymmetrical bandwidth variation, with a narrow band.

In FIG. 9*b*, the reed has been displaced relative to the starting position both into the uppermost z position and also to the left. In this manner, the left ribbon edge is left at the same position, but the right one is displaced in x direction by the distance amount f.

The weaving head for the weft insertion from the right, together with the associated knitting needle 16*b*, have remained at the same position as shown in FIG. 9*a*, whereas the weaving head for the weft insertion from the left, together with the associated knitting needle 10*b*, have been displaced in x direction by the distance amount f.

LIST OF REFERENCE NUMERALS

3 thread guide
4 warp threads
8 shed
9 woven material with variable width
10 weft thread insertion needle for weft-thread insertion from the left
10*b* knitting needle for weft-thread insertion from the left
10*c* carrier for the weft thread insertion needle and the knitting needle for weft-thread insertion from the left
11 axis of the weft thread insertion needle for weft-thread insertion from the left
13 axis of the weft thread insertion needle for weft-thread insertion from the right
14 weft thread for weft-thread insertion from the left
14*a* weft thread guide for weft-thread insertion from the left weft thread for weft-thread insertion from the right
15*a* weft thread guide for weft-thread insertion from the right weft thread insertion needle for weft-thread insertion from the right
16*b* knitting needle for weft-thread insertion from the right
16*c* carrier for the weft thread insertion needle and the knitting needle for weft-thread insertion from the right
20 reed
21 reed teeth
30 rotary actuator for weft-thread insertion from the left
31 rotary actuator for weft-thread insertion from the right
33 connecting bracket for weft-thread insertion from the left
32 connecting bracket for weft-thread insertion from the right
34 toothed pulley drive
x weft direction
y direction of the warp thread
z direction perpendicular to the woven material

The invention claimed is:

1. A ribbon needle weaving loom comprising a weave point, at which warp threads are interweavable to each other by means of at least one weft thread, a device for feeding the warp threads, a device for feeding the at least one weft thread, further comprising a shed forming device for forming a shed from the warp threads, and comprising at least one weft thread insertion needle for inserting a weft thread loop into the shed, and comprising a reed for beating up the weft thread loop and comprising at least one knitting device serving to knit the at least one weft thread at the side directed away from the weft insertion,
characterized in that
the at least one weft thread insertion needle and the at least one knitting device are arranged on a common carrier which is displaceable in and against the weft direction (x).

2. The ribbon needle weaving loom according to claim 1, characterized in that there are provided two weft thread insertion needles being countercurrently introducible into the shed for inserting two weft thread loops into the shed, and two knitting devices, by means of which a respective weft thread is knittable at the respective side directed away from the weft insertion, one weft thread insertion needle and one knitting device each being arranged on a respective common carrier which is displaceable in and against the weft direction (x).

3. The ribbon needle weaving loom according to claim 2, characterized in that the two carriers with their associated weft thread insertion needles and knitting devices are arranged in such manner that the carriers with their associated weft thread insertion needles and knitting devices are displaceable independently to each other, by means of a height staggering of the carrier.

4. The ribbon needle weaving loom according to claim 1, characterized in that the reed has, in the upper region thereof, a respective distance between reed teeth which is different than in the lower region thereof, and that the reed is furthermore displaceable in its height for beating up the woven material of variable width.

5. The ribbon needle weaving loom according to claim 4, characterized in that the reed is displaceable in both the height and in or against the weft direction (x).

6. The ribbon needle weaving loom according to claim 1, characterized in comprising electromechanic actuating drives for displacement of the carrier or the carriers, respectively.

7. The ribbon needle weaving loom according to claim 5, characterized in comprising electromechanic actuating drives for displacement of the reed in the height and also laterally in or against the weft direction (x).

8. The ribbon needle weaving loom according to claim 6, characterized by a control unit for controlling the said electromechanic actuating drives.

9. The ribbon needle weaving loom according to claim 2, characterized in that the reed has, in the upper region thereof, a respective distance between reed teeth which is different than in the lower region thereof, and that the reed is furthermore displaceable in its height for beating up the woven material of variable width.

10. The ribbon needle weaving loom according to claim 9, characterized in that the reed is displaceable in both the height and in or against the weft direction (x).

11. The ribbon needle weaving loom according to claim 3, characterized in that the reed has, in the upper region thereof, a respective distance between reed teeth which is different than in the lower region thereof, and that the reed (20) is furthermore displaceable in its height for beating up the woven material of variable width.

12. The ribbon needle weaving loom according to claim 11, characterized in that the reed is displaceable in both the height and in or against the weft direction (x).

13. The ribbon needle weaving loom according to claim 9, characterized in that the reed is displaceable in both the height and in or against the weft direction (x).

14. The ribbon needle weaving loom according to claim 11, characterized in that the reed is displaceable in both the height and in or against the weft direction (x).

15. The ribbon needle weaving loom according to claim 2, characterized in comprising electromechanic actuating drives for displacement of the carrier or the carriers, respectively.

16. The ribbon needle weaving loom according to claim 3, characterized in comprising electromechanic actuating drives for displacement of the carrier or the carriers, respectively.

17. The ribbon needle weaving loom according to claim 4, characterized in comprising electromechanic actuating drives for displacement of the carrier or the carriers, respectively.

18. The ribbon needle weaving loom according to claim 5, characterized in comprising electromechanic actuating drives for displacement of the carrier or the carriers, respectively.

19. The ribbon needle weaving loom according to claim 6, characterized in comprising electromechanic actuating drives for displacement of the reed in the height and also laterally in or against the weft direction (x).

20. The ribbon needle weaving loom according to claim 7, characterized by a control unit for controlling the said electromechanic actuating drives.

* * * * *